United States Patent [19]

Phillips et al.

[11] Patent Number: 4,766,441

[45] Date of Patent: Aug. 23, 1988

[54] SPOKEWHEEL CONVERTIBLE ANTENNA FOR BCA SYSTEMS ABOARD SUBMARINES

[75] Inventors: Raymond J. Phillips, Oakdale; Anthony R. Susi, Waterford, both of Conn.

[73] Assignee: The United States of America as represented by the Secretary of the Navy, Washington, D.C.

[21] Appl. No.: 15,392

[22] Filed: Feb. 6, 1987

[51] Int. Cl.[4] ..... H01Q 1/34

[52] U.S. Cl. ..... 343/709; 343/719

[58] Field of Search ..... 343/709, 710, 707, 846, 343/719; 174/101.5

[56] References Cited

U.S. PATENT DOCUMENTS

| | | | |
|---|---|---|---|
| 3,599,213 | 8/1971 | Fessenden | 343/710 |
| 3,662,260 | 5/1972 | Thomas et al. | 343/709 |
| 3,665,478 | 5/1972 | Dempsey | 343/846 |
| 4,463,358 | 7/1984 | Phillips | 343/709 |

*Primary Examiner*—William L. Sikes
*Assistant Examiner*—Michael C. Wimer
*Attorney, Agent, or Firm*—Arthur A. McGill; Prithvi C. Lall; Michael J. McGowan

[57] ABSTRACT

A spokewheel convertible buoyant cable antenna is comprised of a multiplicity of machined metal and molded or extruded plastic components. These parts are designed to be quickly assembled in such a way as to be watertight at all practical depths. They have sufficient tensile strength so as to be towed at reasonable speeds, either on the surface or submerged. The assembly may be disassembled in the field, for repairs. The design also allows it to be easily inserted into a conventional XU-4 type antenna thereby doubling the usefulness of the standard BCA system when this spokewheel capability is needed. The spokewheel version may be quickly converted back to the standard XU-4 version.

2 Claims, 2 Drawing Sheets

SPOKEWHEEL CONVERTIBLE ANTENNA FOR BCA SYSTEMS ABOARD SUBMARINES

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

1. Field of the Invention

The present invention relates to antenna systems. More particularly the invention relates to convertible antenna systems towed from underwater vehicles.

2. Description of the Prior Art

Prior systems used single purpose antennas attached to a dedicated towing/transmission cable having a length of about one thousand feet. The complete prior version was only capable of a single mode of operation such as the XU-4 Buoyant Cable Antenna System or a spokewheel design having solid molded construction that was not field repairable. The spokewheel design was very bulky compared to the configuration of the present invention. This bulkiness always causes storage problems aboard underwater vehicles such as submarines.

SUMMARY OF THE INVENTION

The present invention provides means for converting a standard XU-4 Buoyant Cable Antenna System to a spokewheel mode at will and then reconverting it back to the standard configuration. The spokewheel configuration is capable of field repairs including replacement of the entire spokewheel unit and has in addition improved towing characteristics over the prior art system. Each spoke is assembled through apertures of a hub and a sleeve adapter into a conductive contact adapter that is separated from the sleeve adapter by a spoke insulator. The spokes are then soldered to the contact adapter. The conductive contact adapter is electrically connected to the conductors within the system.

DESCRIPTION OF THE PREFERRED EMBODIMENT

Figure 1:
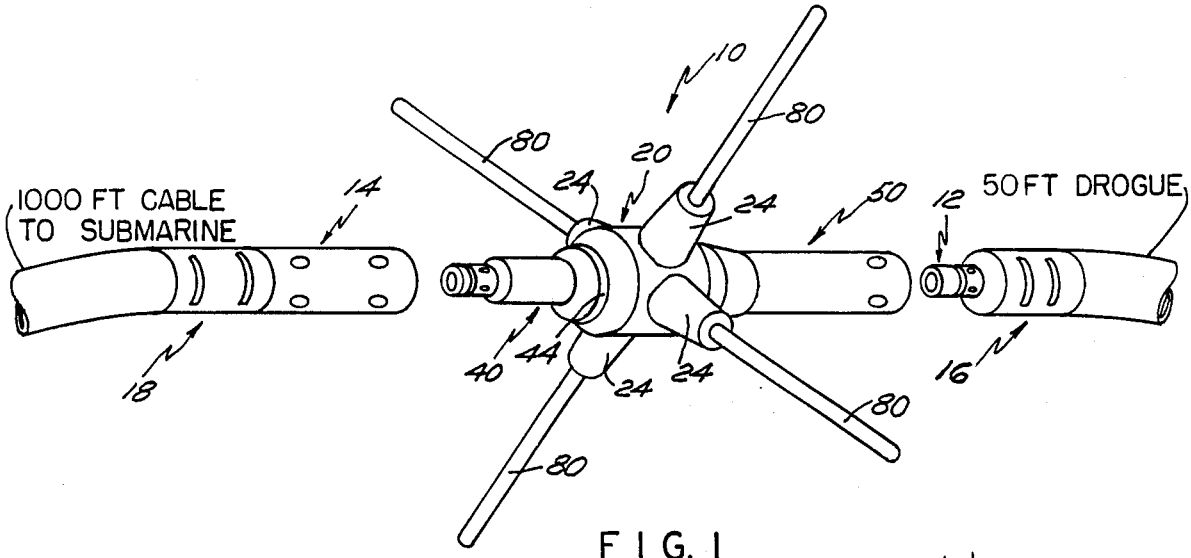
FIG. 1 shows a simplified pictorial representation of the ease of converting the present invention to and from a spokewheel mode.
Figure 3:
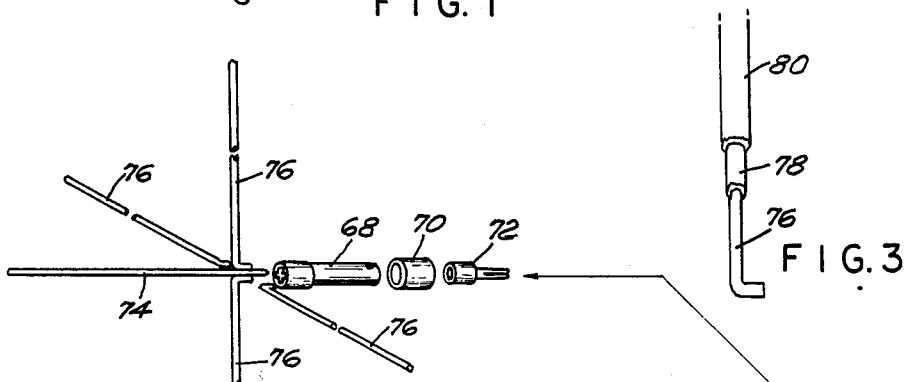
FIG. 3 shows a spoke detail from the spokewheel of FIG. 2.
Figure 2:
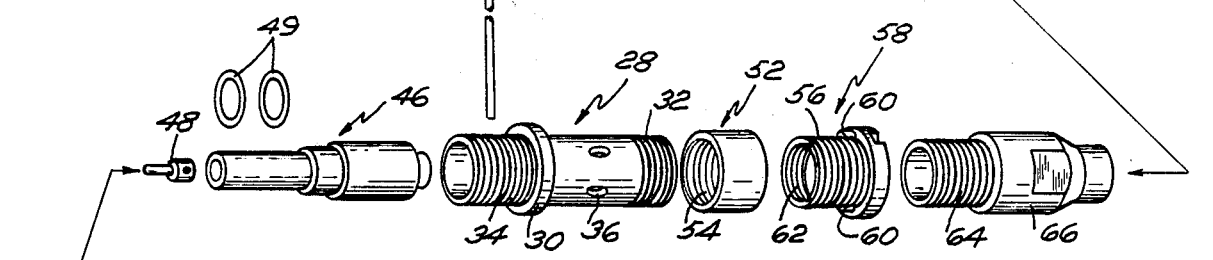
FIG. 2 shows an exploded view of the spokewheel configuration with connecting components.
Figure 2:
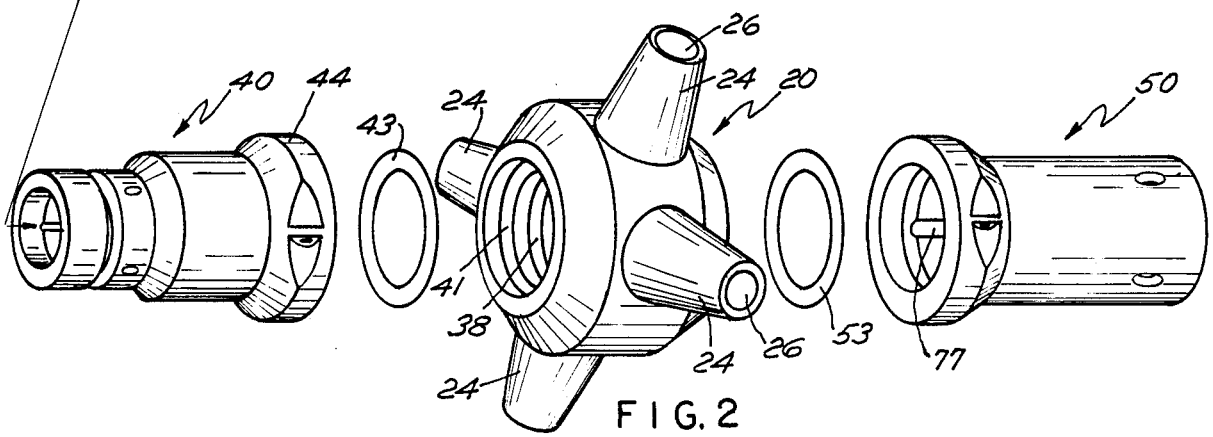
Figure 4:
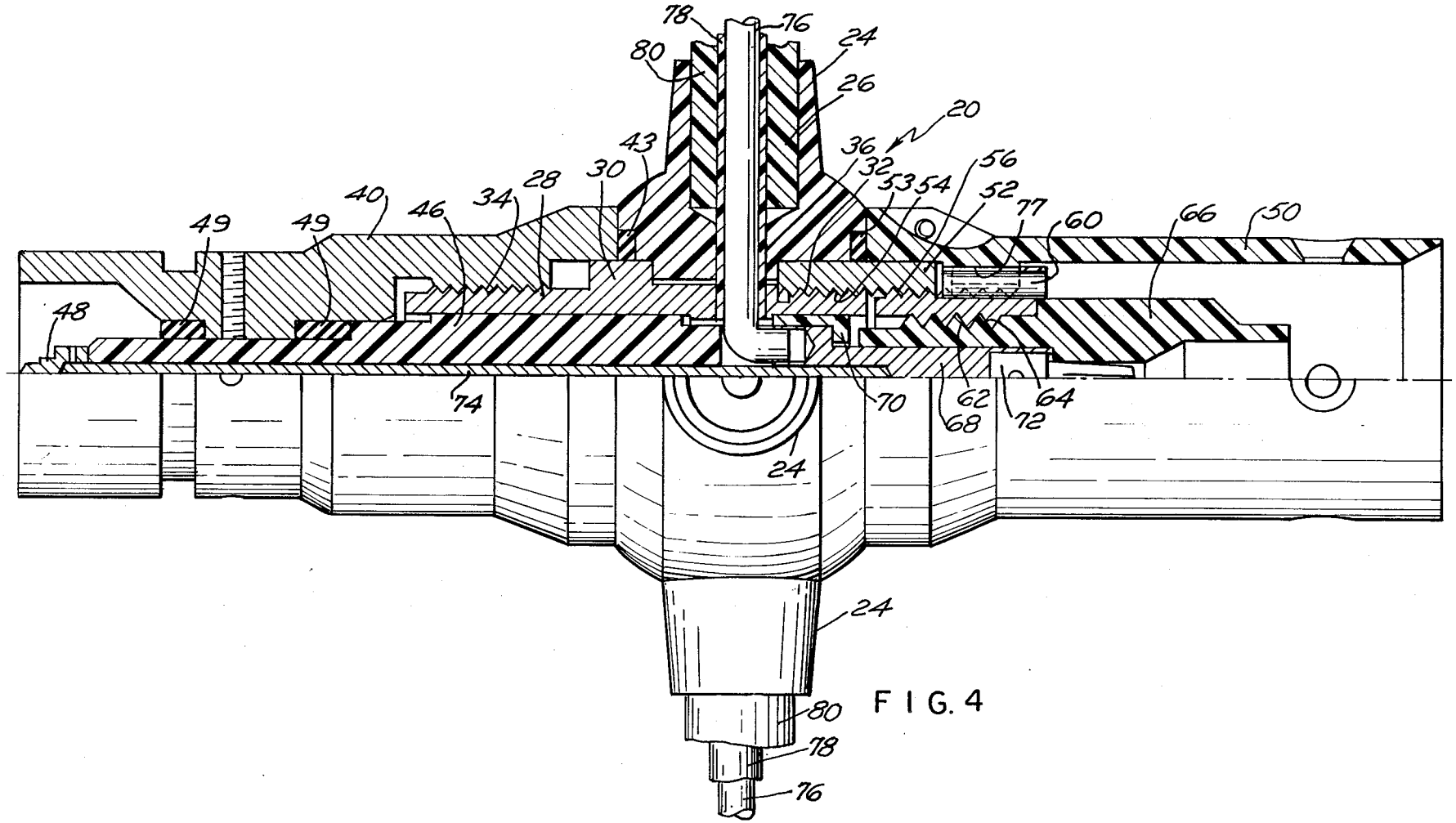
FIG. 4 shows a cross-sectional assembly drawing of the FIG. 2 configuration.

Referring now to FIG. 1 there is shown a spokewheel convertible antenna 10 that connects to an end fitting assembly 12 and an amplifier housing assembly 14. End fitting assembly 12 and amplifier housing assembly 14 have respective cable assemblies 16 and 18 attached to them. Assembly 16 includes a drogue and assembly 18 has a cable extending from a submarine.

Refer now to all figures. There is shown a hub 20 having truncated extensions 24 with respective apertures 26. An adapter sleeve 28 fits inside hub 20. Adapter sleeve 28 has a collar 30, threads 32 and 34, and apertures 36. Collar 30 abuts innermost ridge 38 of hub 20. An amplifier adapter 40 has inner threads that are mated with threads 34 of adapter sleeve 28. An O-ring seal 43 is seated between inner ridge 41, the outer perimeter of collar 30 and end 44 of adapter 40.

A forward insulator 46 is located inside adapter sleeve 28 and amplifier adapter 40. A pair of O-rings 49 abut insulator 46 and adapter 40. A pin contact 48 abuts forward insulator 46.

On the other side of hub 20, end fitting adapter 50 and coupling 52 abut hub 20, with an O-ring seal 53 in between the three components. In addition coupling 52 has interior threads 54 threaded to threads 32 of adapter sleeve 28. Threads 54 of coupling 52 are also mated to outer threads 56 of retaining bushing 58. Retaining bushing 58 has two aligning pins 60. Inner threads 62 of bushing 58 mate with threads 64 of socket contact insulator 66. A contact adapter 68 has a spoke insulator 70 over one end of it. This spoke insulator 70 abuts the inner surface of adapter sleeve 28. A socket contact 72 fits in contact adapter 68. A center conductor 74 is solder connected between pin contact 48 and conductive contact adapter 68.

Four spokes 76 are inserted through hub 20 to contact adapter 68. The four spokes have an insulating nylon liner 78 and a polyethylene cover 80 over them.

In assembling the present invention adapter sleeve 28 is inserted in hub 20 so that apertures 36 align with apertures 26. Each spoke 76 is then inserted through an aperture 26 of hub 20 and an aperture 36 of adapter sleeve 28. The bent end of each spoke 76 is inserted into a mating recess of contact adapter 68. Center conductor 74 is then inserted into the center recess of contact adapter 68. The four spokes 76 and center conductor 74 are then simultaneously soldered into contact adapter 68. The alignment of the above components can be facilitated by using a dummy component replacing socket contact insulator 66, retaining bushing 58 and coupling 52. Socket contact 72 is soldered into recess of contact adapter 68.

O-ring 43 is then positioned into recess 41 of hub 20. Forward insulator 46 is placed over center conductor 74. Contact 48 is soldered to center conductor 74. An O-ring 49 is placed on forward insulator 46. Amplifier adapter 40 is threaded onto piece 28. The other O-ring is then inserted into recess between amplifier adapter 40 and forward insulator 46.

Retaining bushing 58 is inserted into end fitting adapter 50 so that aligning pins 60 of retaining bushing 58 fit into mating recesses 77 of end fitting adapter 50. Coupling 52 is threaded onto retaining bushing 58. Socket contact insulator 66 is threaded into retaining bushing 58. Spoke insulator 70 is placed into recess between contact adapter 68 and adapter sleeve 28. O-ring 53 is placed into the recess of hub 20. Threads 32 of adapter sleeve 28 are threaded into threads 54 of coupling 52. Nylon liners 78 and polyethylene covers 80 are placed on spokes 76. Polyethylene covers 80 are molded to truncated extrusions 24 of hub 20. This completes the mechanical and electrical assembly.

There has therefore been described a spokewheel convertible antenna in which a spokewheel design is demountable, field repairable, easily stored in minimal space and can be inserted into a standard XU-4 type BCA. It therefore renders the standard XU-4 antenna capable of being used for two purposes, i.e., as a spokewheel omni-directional VHF mode, or converted back to the standard buoyant cable HF directional mode.

The prior spokewheel design was attached to a transmission cable, usually 1000 feet, and to a 50 foot drogue on the after end for stability. The prior spokewheel hub has a molded section joining the cable to the spoke section that is in turn connected to the tail section. It requires a silver-laden polyethylene coating on the molded hub so as to ground to sea water. The present invention has a metal fitting adjacent the spokes that serves as a ground function.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A spokewheel convertible antenna system comprising:

a spokewheel antenna having a plurality of spokes wherein each of said plurality of spokes has insulated covering over a portion of said plurality of spokes;

a hub assembly having a hub with a plurality of apertures with each of said plurality of apertures having one of said plurality of spokes inserted into it, said hub further having a plurality of truncated extensions with each one of said truncated extensions having one of said plurality of apertures, said hub assembly further comprises an adapter sleeve inserted inside said hub, said adapter sleeve having a plurality of apertures aligned with said apertures of said truncated extensions, an amplifier adapter extending over one end of said adapter sleeve and abutting with one side of said hub, a seal located between said hub, said adapter sleeve and said amplifier adapter, a forward insulator located inside said adapter sleeve and said amplifier adapter, a pair of spaced insulators abutting said amplifier adapter and said forward insulator, an end fitting adapter abutting the other side of said hub, a coupling located inside said end fitting adapter and said hub, a seal located between said end fitting adapter, said hub and said coupling, said coupling having interior threads threaded to said adapter sleeve, a retaining bushing having aligning pins and having outer threads threaded to said coupling interior threads, and a socket contact insulator having outer threads threaded to said retaining bushing;

a cable assembly;

first cable connecting means for connecting to the adapter amplifier side of said hub assembly and to said cable assembly;

a drogue assembly;

second cable connecting means for connecting to the end fitting adapter side of said hub assembly and for connecting to said drogue assembly; and conductor means for conducting electrical signals connected to each of said plurality of spokes and said conductor means having connecting means for connecting to conductive elements within said cable assembly and said drogue assembly.

2. A spokewheel convertible antenna system according to claim 1 wherein said conductor means further comprises:

a center conductor;

a contact adapter located inside and abutting said socket contact insulator, said contact adapter has each of said plurality of spokes and said center conductor soldered to recesses in one end of said contact adapter;

a spoke insulator inserted between said contact adapter and said adapter sleeve;

a socket contact soldered in the other end of said contact adapter; and a pin contact abutting said forward insulator and said pin contact being soldered to said center conductor.

* * * * *